US009198265B2

(12) United States Patent
Wu

(10) Patent No.: US 9,198,265 B2
(45) Date of Patent: Nov. 24, 2015

(54) ILLUMINATION APPARATUS AUTOMATICALLY ADJUSTED WITH TIME

(71) Applicant: Lextar Electronics Corporation, Hsinchu (TW)

(72) Inventor: En-Ming Wu, Taipei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/225,474

(22) Filed: Mar. 26, 2014

(65) Prior Publication Data

US 2015/0061525 A1 Mar. 5, 2015

(30) Foreign Application Priority Data

Aug. 30, 2013 (TW) ..... 102131390 A

(51) Int. Cl.
*H05B 37/02* (2006.01)

(52) U.S. Cl.
CPC ..... *H05B 37/0281* (2013.01)

(58) Field of Classification Search
CPC ..... H05B 33/0815; H05B 33/0818; H05B 37/029; H05B 41/3925; H05B 41/2828; H05B 33/0803
USPC ..... 315/185 R, 193, 201, 294, 360
See application file for complete search history.

(56) References Cited

U.S. PATENT DOCUMENTS

| | | | | | |
|---|---|---|---|---|---|
| 2,183,780 | A * | 12/1939 | Wilcox | ..... | 340/920 |
| RE21,377 | E * | 2/1940 | Wilcox | ..... | 340/920 |
| 5,160,853 | A * | 11/1992 | Simon et al. | ..... | 307/140 |
| 2007/0085996 | A1 * | 4/2007 | Mangan et al. | ..... | 356/39 |
| 2007/0285070 | A1 * | 12/2007 | Yang | ..... | 323/282 |
| 2009/0195160 | A1 * | 8/2009 | Shinogi | ..... | 315/39 |
| 2010/0295454 | A1 | 11/2010 | Reed | | |
| 2011/0043328 | A1 * | 2/2011 | Bassali | ..... | 340/5.71 |
| 2011/0062874 | A1 * | 3/2011 | Knapp | ..... | 315/158 |
| 2011/0157138 | A1 * | 6/2011 | Origuchi et al. | ..... | 345/211 |

(Continued)

OTHER PUBLICATIONS

TW Office Action dated Jul. 27, 2015 in corresponding Taiwan application (No. 102131390).

*Primary Examiner* — Douglas W Owens
*Assistant Examiner* — Syed M Kaiser
(74) *Attorney, Agent, or Firm* — McClure, Qualey & Rodack, LLP

(57) ABSTRACT

An illumination apparatus which comprises a timing module, a control module and a first power conversion module and can be automatically adjusted with time is provided. The timing module sets the time into N sessions, and generates an $i^{th}$ timing signal according to the $i^{th}$ session corresponding to the current time, wherein i and N are natural numbers and i≤N. The control module reads the $i^{th}$ timing signal from the timing module, and outputs an $i^{th}$ control signal. The first power conversion module, coupled to an AC power supply, the control module and a first light source, converts the AC power supply signal into a DC power signal and outputs the DC power signal to the control module, and outputs an $i^{th}$ DC driving signal to drive the first light source to emit light of the $i^{th}$ situation after receiving the $i^{th}$ control signal.

14 Claims, 3 Drawing Sheets

(56) References Cited

U.S. PATENT DOCUMENTS

| | | | | |
|---|---|---|---|---|
| 2011/0175587 | A1* | 7/2011 | Hosotani | 323/283 |
| 2012/0080944 | A1* | 4/2012 | Recker et al. | 307/25 |
| 2013/0141013 | A1* | 6/2013 | Kodama et al. | 315/294 |
| 2013/0154587 | A1* | 6/2013 | Gilliom | 323/267 |
| 2013/0201316 | A1* | 8/2013 | Binder et al. | 348/77 |
| 2014/0062341 | A1* | 3/2014 | Reed et al. | 315/360 |
| 2015/0061525 | A1* | 3/2015 | Wu | 315/201 |

* cited by examiner

ILLUMINATION APPARATUS AUTOMATICALLY ADJUSTED WITH TIME

This application claims the benefit of Taiwan application Serial No. 102131390, filed Aug. 30, 2013, the subject matter of which is incorporated herein by reference.

BACKGROUND OF THE INVENTION

1. Field of the Invention

The invention relates in general to an illumination apparatus, and more particularly to an illumination apparatus automatically adjusted with time.

2. Description of the Related Art

Illumination is an indispensable necessity for human's daily life. Different intensities and colors of artificial light give people different psychological feelings. Currently, the lighting industry has widely used light dimming technology in human factor illumination system.

Currently, the light dimming technology used in the illumination system includes tri-electrode AC switch (TRIAC) light dimming, pulse width modulation (PWM) light dimming and switch type light dimming. However, the above light dimming technologies are passive and require users to manually adjust the light sources. In other words, conventional light dimming technologies cannot adjust the brightness and/or color temperature of the illumination system according to peoples' daily routines.

Therefore, how to provide an illumination apparatus automatically adjusted with time according to people's daily routines has become a prominent task for the industries.

SUMMARY OF THE INVENTION

The invention is directed to an illumination apparatus capable of emitting light corresponding to the situations with different time.

According to one embodiment of the present invention, an illumination apparatus automatically adjusted with time is provided. The illumination apparatus comprises a timing module, a control module and a first power conversion module. The timing module sets the time into N sessions, and generates an $i^{th}$ timing signal according to the $i^{th}$ session corresponding to the current time, wherein i and N are natural numbers and $i \leq N$. The control module reads the $i^{th}$ timing signal from the timing module and correspondingly outputs an $i^{th}$ control signal. The first power conversion module, coupled to an AC power supply, the control module and a first light source, converts the AC power supply signal into a DC power signal and outputs the DC power signal to the control module, and correspondingly outputs an $i^{th}$ DC driving signal to drive the first light source to emit light of the $i^{th}$ situation after receiving the $i^{th}$ control signal from the control module.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
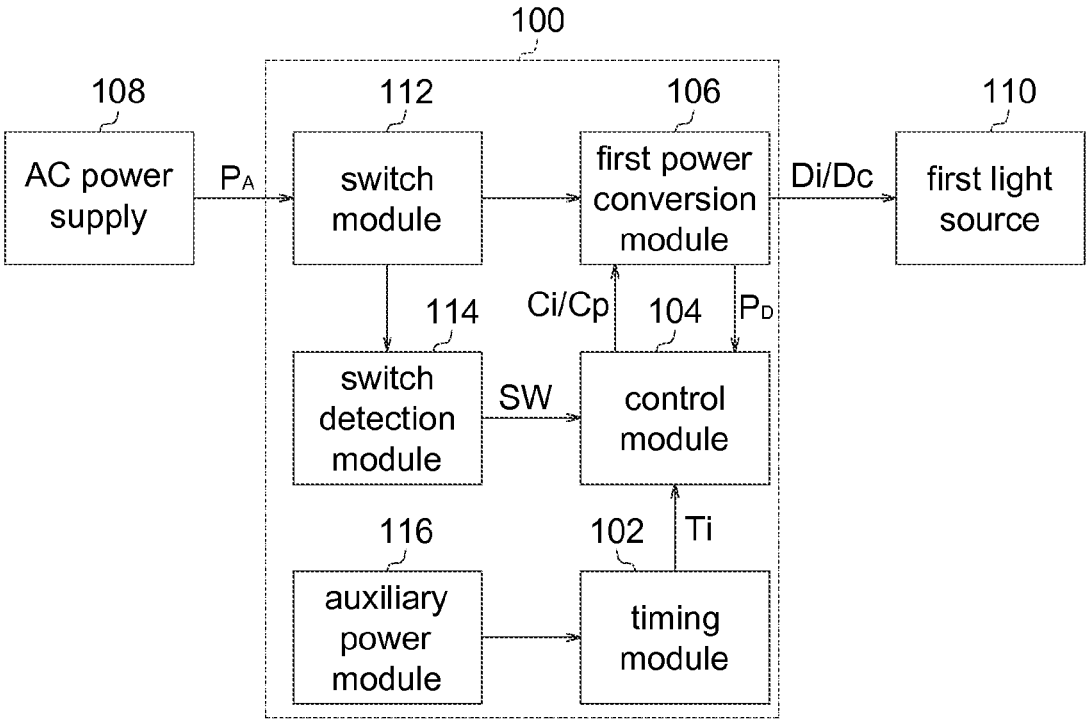
FIG. 1 is a block diagram of an illumination apparatus according to an embodiment of the invention.

Referring to FIG. 1, a block diagram of an illumination apparatus according to an embodiment of the invention is shown. As indicated in FIG. 1, the illumination apparatus 100 comprises a timing module 102, a control module 104 and a first power conversion module 106. The timing module 102 is adapted to set the time into N sessions, and to generate an $i^{th}$ timing signal Ti according to the $i^{th}$ session corresponding to the current time, wherein i and N are natural numbers and $i \leq N$. The control module 104 is adapted to read the $i^{th}$ timing signal Ti from the timing module 102, and correspondingly outputs an $i^{th}$ control signal Ci. The first power conversion module 106, coupled to an AC power supply 108, the control module 104 and the first light source 110, converts the AC power supply signal $P_A$ into a direct current (DC) power signal $P_D$ and outputs the DC power signal $P_D$ to the control module 104, and correspondingly outputs an $i^{th}$ DC driving signal Di which drives the first light source 110 to emit light of the $i^{th}$ situation after receiving the $i^{th}$ control signal Ci from the control module 104.

Taking N being equal to 3 for example, the timing module 102 sets the time into 3 sessions, namely, a first session (such as 06:00~18:00), a second session (such as 18:00~24:00) and a third session (such as 24:00~06:00). When it is 8.00 am (corresponding to the first session), the timing module 102 outputs a first timing signal T1 corresponding to the first session to the control module 104. The control module 104 obtains electrical energy from the DC power signal $P_D$ outputted from the first power conversion module 106, and then generates a corresponding first control signal C1 according to the first timing signal T1. After receiving the first control signal C1, the first power conversion module 106 adjusts the magnitude of the first direct current (DC) driving signal D1 outputted to the first light source 110 according to the received first control signal C1 and further outputs the adjusted first DC driving signal D1 to the first light source 110 which accordingly emits a first situation light. Based on the same principles of operation, when the time falls in the second session or the third session, the control module 104 correspondingly outputs a second control signal C2 or a third control signal C3 to the first power conversion module 106, which accordingly drives the first light source 110 to emit a second situation light or a third situation light. However, the invention is not limited thereto, and the value of N can be determined according to actual needs and can be set to be larger than 3 for defining more sessions such that the situation light emitted from the first light source 110 can vary with time.

The first light source 110 can be realized by such as a light emitting diode (LED), an organic light emitting diode (OLED) or other solid state light source, and each $i^{th}$ situation light can have respective color temperature and/or brightness level. For instance, the first situation light to the third situation light can be designed according to people's daily routines in different time sessions. For instance, since the first session (06:00~18:00) normally corresponds to a work session, the first situation light can be set to have a high color temperature (such as 6500K) and a high brightness level (such as 100% brightness output) to make it easier for people to focus their attention and increase their efficiency. Since the second session normally corresponds to a break session, the second situation light can be set to have a low color temperature (such as 3000K~4500K) and a medium brightness level (such as 80% brightness output) such that people feel warm and relaxed. Since the third session normally corresponds to people's sleep session, the third situation light can be set to have a low color temperature (such as 3000K~4500K) and a low brightness level (such as 10% brightness output) to simulate the effect of night light.

Referring to FIG. 1 again, it is shown that the illumination apparatus 100 further comprises a switch module 112, a switch detection module 114 and an auxiliary power module 116. The switch module 112 is coupled between the AC power supply 108 and the first power conversion module 106, and the user can determine whether to output the AC power supply signal $P_A$ generated by the AC power supply 108 to the first power conversion module 106 to switch the illumination apparatus 100 to a turn-on state or a turn-off state by using the switch module 112. In other words, the switching of the switch module 112 controls whether to provide electrical energy to drive the first light source 110. The switch module 112, realized by various types of conventional switches, can switch the turn-on state and the turn-off state in a mechanic or an electronic manner.

The switch detection module 114 is coupled between the switch module 112 and the control module 104 for detecting the number of switching the switch module 112 within a period T. When the user turns on (ON) and then immediately turns off (OFF) the switch module 112 and turns on (ON) the switch module 112 again within the period T (the switch module is switched from ON→OFF→ON), the control module 104 will stop reading the $i^{th}$ timing signal Ti outputted from the timing module 102 and will correspondingly generate a switch signal SW according to the number of switching. Then, the control module 104 outputs a control signal Cp corresponding to predetermined lighting situation to the first power conversion module 106 according to the switch signal SW, and the first power conversion module 106 correspondingly outputs a driving current Dc to the first light source 110. When the first light source 110 is driven by the driving current D, the first light source 110 outputs a light with maximum brightness level.

In an example, the switch detection module 114 is coupled to a terminal point of the switch module 112 and detects the change of voltage/current at the terminal point to determine the number of switching the switch module 112 and accordingly determine whether to output the switch signal SW. For instance, when the user turns on the switch module 112, the switch detection module 114 detects whether the change in voltage/current at the terminal point within the period T (such as 3 seconds) is conformed to a predetermined condition (such as the switching from ON→OFF→ON). If yes, the switch detection module 114 outputs the switch signal SW such that the control module 104 stops reading the $i^{th}$ timing signal and generates the control signal Cp, which makes the first power conversion module 106 output driving current Dc to drive the first light source 110 to illuminate. Through the switching of the switch module 112, the user can control the illumination apparatus 100 to operate in an automatic light dimming mode (the first light source 110 is automatically adjusted with the time) or a predetermined illumination mode (the first light source 110 emits a light with predetermined chromatic aberration and/or predetermined brightness level irrelevant with the time). However, the invention is not limited thereto, and any elements which detect the switching of a switch so as to output a corresponding switch signal to control other module or element can be used as the switch detection module 114 of the invention.

The auxiliary power module 116 is coupled to the timing module 102 for providing electrical energy to the timing module 102. The auxiliary power module 116 can be realized by such as a lithium battery or an energy storage element capable of providing electrical energy for a long duration. By using the auxiliary power module 116, the timing module 102 still can obtain electrical energy and operate even when the illumination apparatus 100 is not connected to the AC power supply 108 or the switch module 112 is turned off.

Figure 2:
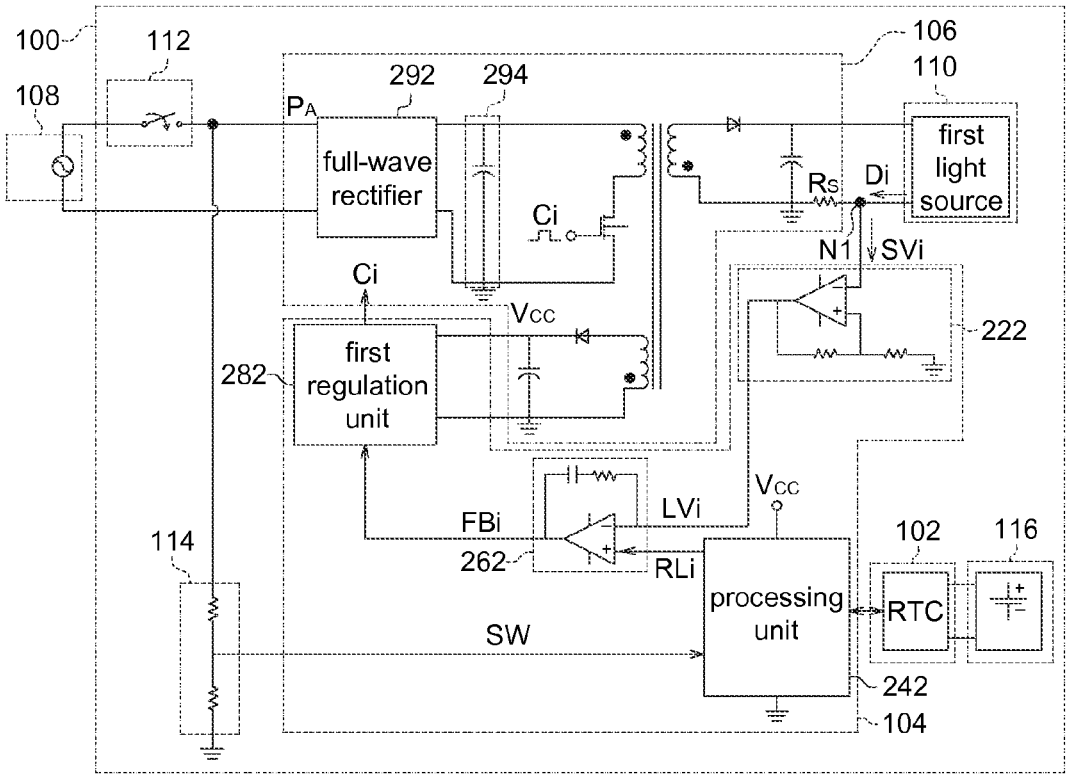
FIG. 2 is a circuit diagram of an illumination apparatus according to an embodiment of the invention.

Referring to FIG. 2, a circuit diagram of an illumination apparatus according to an embodiment of the invention is shown. As indicated in FIG. 2, the control module 104 and the first light source 110 are coupled to the first node N1. The $i^{th}$ DC driving signal Di generates an $i^{th}$ sensing voltage signal SVi at the first node N1 after flowing through the first light source 110. In the present example, the first node N1 is coupled to a grounded sensing resistor Rs. When the $i^{th}$ DC driving signal Di flows to the ground terminal through the sensing resistor Rs, an $i^{th}$ sensing voltage signal SVi is generated at the first node N1. The $i^{th}$ sensing voltage signal SVi is a voltage signal whose voltage is less than 1V.

The control module 104 comprises a first amplification unit 222, a processing unit 242, a first comparison unit 262 and a first regulation unit 282. The first amplification unit 222 is coupled to the first node N1 for amplifying the $i^{th}$ sensing voltage signal SVi to generate an $i^{th}$ light source voltage signal LVi. The first amplification unit 222 can be realized by the amplifier circuit as indicated in FIG. 2, but the invention is not limited thereto.

The processing unit 242 reads the $i^{th}$ timing signal Ti from the timing module 102 to determine the $i^{th}$ session and correspondingly output an $i^{th}$ reference level signal RLi according to the $i^{th}$ timing signal Ti. For instance, the processing unit 240 comprises a database for storing a plurality of adjustment data. The processing unit 240 selects the $i^{th}$ reference level signal RLi according to the determined $i^{th}$ session and the adjustment data. In an example, the processing unit 240 is realized by a multipoint control unit (MCU) allowing the designer to program an MCU code to control the $i^{th}$ reference level signal RLi corresponding to the $i^{th}$ timing signal Ti. The timing module 102 is such as a real time clock (RTC) module. The database disclosed above can be realized by a look-up table.

The first comparison unit 262 is coupled to the first amplification unit 222 and the processing unit 242 for receiving the $i^{th}$ light source voltage signal LVi and the $i^{th}$ reference level signal RLi and correspondingly outputting an $i^{th}$ feedback signal FBi. In the present embodiment, the first comparison unit 262 comprises a computation amplifier whose two input terminals receive the $i^{th}$ light source voltage signal LVi and the $i^{th}$ reference level signal RLi, respectively. In this way, when the first comparison unit 262 is in a steady state, the level of the $i^{th}$ light source voltage signal LVi is substantially equivalent to the level of the $i^{th}$ reference level signal RLi. Therefore, the output of the $i^{th}$ DC driving signal Di can be indirectly controlled by adjusting the magnitude of the $i^{th}$ reference level signal RLi.

The first regulation unit 282 is coupled to the first comparison unit 262 for generating a corresponding pulse width modulation signal (PWM) used as the $i^{th}$ control signal Ci according to the $i^{th}$ feedback signal FBi. The length of the duty cycle of the $i^{th}$ control signal Ci is positively correlated with the brightness level of the first light source 110. Furthermore, the magnitude of the $i^{th}$ DC driving signal Di generated by the first power conversion module 106 can be controlled according to the length of the duty cycle of the $i^{th}$ control signal Ci so as to achieve the effect of adjusting the first light source 110. In an example, the first regulation unit 282 can be realized by a control integrated circuit or can be integrated with the processing unit 242.

Referring to FIG. 2, it is shown that the first power conversion module 106 at least comprises a full-wave rectifier 292 and a low pass filter 294. The full-wave rectifier 292 can be realized by a bridge type full-wave rectification circuit or a circuit equipped with full-wave rectification function. The low pass filter 294 can be realized by a capacitor or a conventional low pass filter circuit. After the switch module 112 is turned on, the full-wave rectifier 292 receives an AC power supply signal $P_A$ from the switch module 112 and performs rectification on the received AC power supply signal $P_A$, and the low pass filter 294 immediately performs low filter operation on the rectified power signal to generate a DC power signal $P_D$.

The control module 104 generates an $i^{th}$ control signal Ci after receiving the DC power signal $P_D$ from the first power conversion module 106 and obtains electric energy (such as voltage Vcc). Then, the first power conversion module 106 adjusts the magnitude of the electric energy outputted to the first light source 110 (that is, the $i^{th}$ DC driving signal Di) according to the magnitude of the $i^{th}$ control signal Ci to control the brightness level and/or color temperature of the light emitted from the first light source 110.

In the example as indicated in FIG. 2, the switch detection module 114 is realized by a resistor string formed by a plurality of serially connected resistors. One terminal of the resistor string is coupled to one terminal of the switch module 112. The switch signal SW captured from one node of the resistor string reflects the change in the voltage or current at the terminal of the switch module 112.

Figure 3:
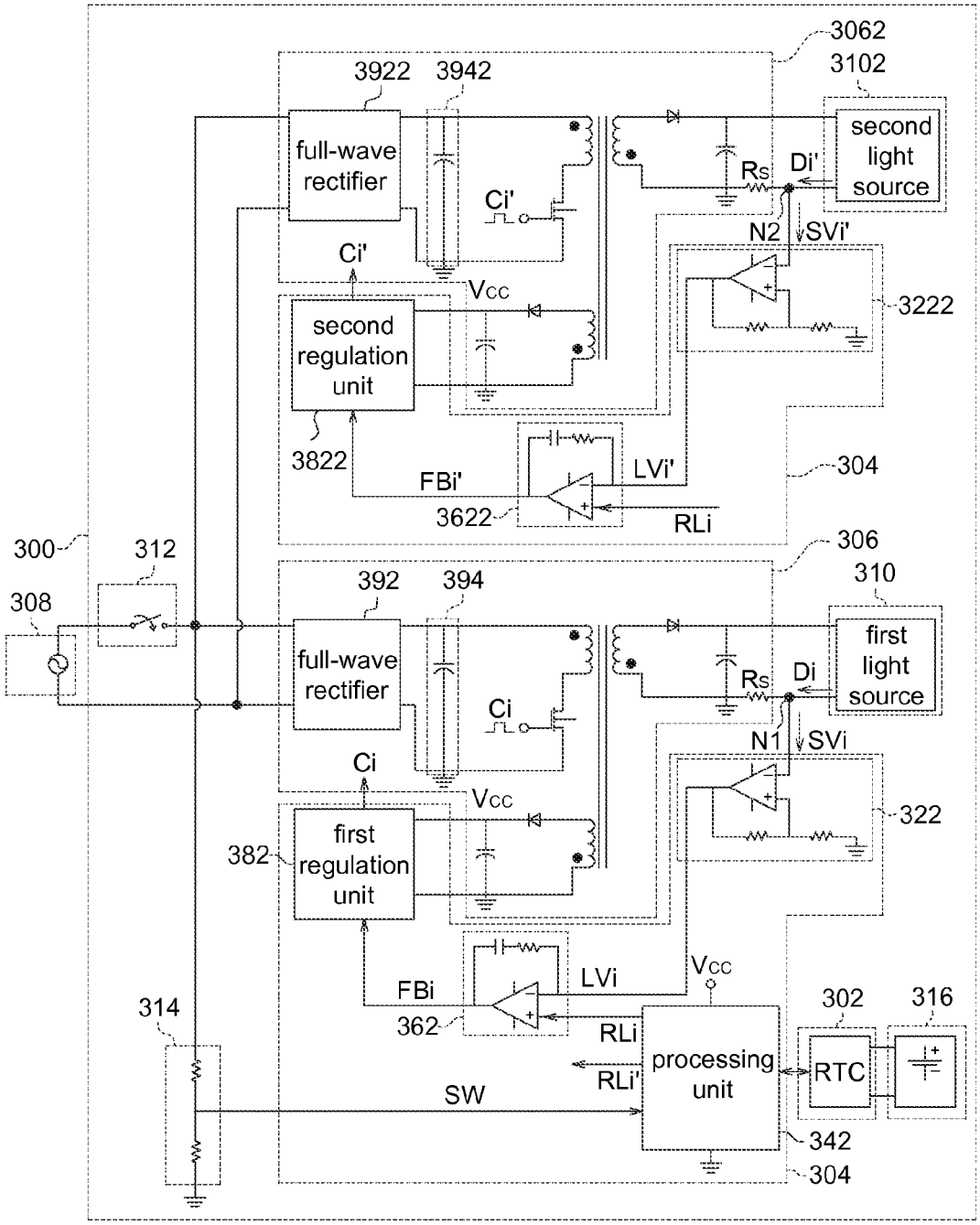
FIG. 3 is a circuit diagram of an illumination apparatus according to another embodiment of the invention.

Referring to FIG. 3, a circuit diagram of an illumination apparatus 300 according to another embodiment of the invention is shown. The illumination apparatus 300 is different from the illumination apparatus 100 of FIG. 2 in that the illumination apparatus 300 further comprises a second power conversion module 3062. The circuit structure of the second power conversion module 3062 is similar to that of the first power conversion module 106 of FIG. 2. As indicated in FIG. 3, the second power conversion module 3062 is coupled to an AC power supply 308 through the switch module 312, and is further coupled to the control module 304 and the second light source 3102. After receiving the $i^{th}$ control signal Ci' corresponding to the $i^{th}$ timing signal Ti from the control module 304, the second power conversion module 3062 correspondingly outputs an $i^{th}$ DC driving signal Di' to drive the second light source 3102.

In the present embodiment of the invention, both the second light source 3102 and the first light source 310 are realized by an LED, and the color temperature of the second light source 3102 is different that of the first light source 310. The light emitted from the second light source 3102 and the light emitted from the first light source 310 can be mixed to generate a light with a desired color temperature. However, the invention is not limited thereto. The illumination apparatus may comprise more power conversion modules for driving their corresponding light sources and mixing the lights. Besides, the first light source 310 and the second light source 3102 can also be realized by other generally known light sources.

Like the circuit structure of FIG. 2, the control module 304 and the second light source 3102 are coupled to a second node N2. The $i^{th}$ DC driving signal Di' generates an $i^{th}$ sensing voltage signal SVi' at the second node N2 after flowing through the second light source 320 (through a sensing resistor Rs). The processing unit 304 further correspondingly outputs an $i^{th}$ reference level signal RLi' according to the $i^{th}$ timing signal Ti. The processing unit 340 comprises a database for storing a plurality of adjustment data, and selects $i^{th}$ reference level signals RLi and RLi' according to the determined $i^{th}$ session and the adjustment data.

As indicated in FIG. 3, the control module 304 further comprises a second amplification unit 3222, a second comparison unit 3622 and a second regulation unit 3822 in addition to the first amplification unit 322, the processing unit 342, the first comparison unit 362 and the first regulation unit 382. The second amplification unit 3222 is coupled to the second node N2 for amplifying the $i^{th}$ sensing voltage signal SVi' to generate an $i^{th}$ light source voltage signal LVi'. The second comparison unit 3622 is coupled to the second amplification unit 3222 and the processing unit 342 for receiving the $i^{th}$ light source voltage signal LVi' and the $i^{th}$ reference level signal RLi', and correspondingly outputting an $i^{th}$ feedback signal FBi'. The second regulation unit 3822 generates a corresponding pulse width modulation (PWD) signal used as the $i^{th}$ control signal Ci' according to the $i^{th}$ feedback signal FBi'. The circuit structures of the second amplification unit 3222, the second comparison unit 3622 and the second regulation unit 3822 are similar to that of the first amplification unit 222, the first comparison unit 262 and the first regulation unit 282 of FIG. 2, but the invention is not limited thereto.

To summarize, the illumination apparatus disclosed in above embodiments of the invention automatically adjusts the brightness level and/or color temperature of light source according to people's daily routines, and possesses humanized design. Furthermore, by using the switching of the switch module, whether the illumination apparatus of the invention will operate in a light dimming mode or a normal illumination mode is determined and the user can thus have more flexible operation.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An illumination apparatus automatically adjusted with time, comprising:

a timing module for setting the time into N sessions, and generating an $i^{th}$ timing signal according to an $i^{th}$ session corresponding to the current time, wherein i and N are natural numbers and $i \leq N$;

a control module for reading the $i^{th}$ timing signal from the timing module and correspondingly outputting an $i^{th}$ control signal;

a first power conversion module, coupled to an AC power supply, the control module and a first light source, for converting a received AC power supply signal into a DC power signal and outputting the DC power signal to the control module, and correspondingly outputting an $i^{th}$ DC driving signal to drive the first light source to emit light of an $i^{th}$ situation after receiving the $i^{th}$ control signal from the control module; and a switch detection module coupled between a switch module and the control module for detecting the number of switching the switch module within a period, wherein when the user turns on the switch module and then immediately turns off the switch module and turns on the switch module again within the period, the control module stops reading the $i^{th}$ timing signal outputted from the timing module, and correspondingly generates a switch signal according to the number of switching, such that the control module outputs a control signal corresponding to a predetermined lighting situation to the first power conversion module according to the switch signal and the first power conversion module correspondingly outputs a driving current to the first light source.

2. The illumination apparatus according to claim 1, wherein each light of the $i^{th}$ situation has a different color temperature and/or brightness level.

3. The illumination apparatus according to claim 2, wherein the switch module coupled between the AC power supply and the first power conversion module, wherein the user determines whether to output the AC power supply signal generated by the AC power supply to the first power conversion module to switch the illumination apparatus to a turn-on state or a turn-off state by using the switch module.

4. The illumination apparatus according to claim 1, further comprising:

an auxiliary power module coupled to the timing module for providing power to the timing module.

5. The illumination apparatus according to claim 1, wherein the first light source is realized by an LED.

6. The illumination apparatus according to claim 1, wherein when the first light source is driven by the driving current, the first light source emits a light with maximum brightness.

7. An illumination apparatus automatically adjusted with time, comprising:

a timing module for setting the time into N sessions, and generating an $i^{th}$ timing signal according to an $i^{th}$ session corresponding to the current time, wherein i and N are natural numbers and $i \leq N$;

a control module for reading the $i^{th}$ timing signal from the timing module and correspondingly outputting an $i^{th}$ control signal; and a first power conversion module, coupled to an AC power supply, the control module and a first light source, for converting a received AC power supply signal into a DC power signal and outputting the DC power signal to the control module, and correspondingly outputting an $i^{th}$ DC driving signal to drive the first light source to emit light of an $i^{th}$ situation after receiving the $i^{th}$ control signal from the control module, wherein the control module and the first light source are coupled to a first node, the $i^{th}$ DC driving signal generates an $i^{th}$ sensing voltage signal at the first node after flowing through the first light source, and the control module comprises:

a first amplification unit, coupled to the first node, for amplifying the $i^{th}$ sensing voltage signal to generate an $i^{th}$ light source voltage signal;

a processing unit for reading the $i^{th}$ timing signal from the timing module and determining the $i^{th}$ session according to the $i^{th}$ timing signal to correspondingly output an $i^{th}$ reference level signal;

a first comparison unit coupled to the first amplification unit and the processing unit for receiving the $i^{th}$ light source voltage signal and the $i^{th}$ reference level signal, and correspondingly outputting an $i^{th}$ feedback signal; and a first regulation unit coupled to the first comparison unit for generating an $i^{th}$ pulse width modulation signal used as the $i^{th}$ control signal according to the $i^{th}$ feedback signal.

8. The illumination apparatus according to claim 7, wherein the first comparison unit makes the level of the $i^{th}$ light source voltage signal substantially equal to that of the $i^{th}$ reference level signal.

9. The illumination apparatus according to claim 7, wherein the illumination apparatus further comprises:

a second power conversion module coupled to the AC power supply, the control module and a second light source, wherein the second power conversion module correspondingly outputs another $i^{th}$ DC driving signal to drive the second light source after receiving another $i^{th}$ control signal corresponding to the $i^{th}$ timing signal from the control module.

10. The illumination apparatus according to claim 9, wherein the color temperature of the second light source is different from that of the first light source.

11. The illumination apparatus according to claim 9, wherein the control module and the second light source are coupled to a second node, the another $i^{th}$ DC driving signal generates another $i^{th}$ sensing voltage signal at the second node after flowing through the second light source, the processing unit further correspondingly output another $i^{th}$ reference level signal according to the $i^{th}$ timing signal, and the control module further comprises:

a second amplification unit, coupled to the second node, for amplifying the another $i^{th}$ sensing voltage signal to generate another $i^{th}$ light source voltage signal;

a second comparison unit, coupled to the second amplification unit and the processing unit, for receiving another $i^{th}$ light source voltage signal and another $i^{th}$ reference level signal, and correspondingly outputting another $i^{th}$ feedback signal; and a second regulation unit for generating another $i^{th}$ pulse width modulation signal used as the another $i^{th}$ control signal according to the another $i^{th}$ feedback signal.

12. The illumination apparatus according to claim 11, wherein the processing unit comprises:

a database for storing a plurality of adjustment data, wherein the processing unit selects the $i^{th}$ reference level signal and the another $i^{th}$ reference level signal according to the $i^{th}$ session and the adjustment data.

13. The illumination apparatus according to claim 9, wherein the second light source is realized by a light emitting diode (LED).

14. The illumination apparatus according to claim 9, wherein each of the first power conversion module and the second power conversion module comprises a full-wave rectifier and a low pass filter.

* * * * *